United States Patent [19]

Lenglet et al.

[11] Patent Number: 4,899,567

[45] Date of Patent: Feb. 13, 1990

[54] METHOD AND APPARATUS FOR BENDING TUBES WITH END FITTINGS

[75] Inventors: Michel Lenglet, Le Coudray Montceaux; Andri Sens, Dammarie Les Lys, both of France

[73] Assignee: Societe Nationale d'Etude et de Construction de Moteurs d'Aviation (SNECMA), Paris, France

[21] Appl. No.: 276,475

[22] Filed: Nov. 28, 1988

[30] Foreign Application Priority Data

Dec. 2, 1987 [FR] France ..... 87 16699

[51] Int. Cl.[4] ..... B21D 7/04

[52] U.S. Cl. ..... 72/159

[58] Field of Search ..... 72/149, 150, 154, 157, 72/158, 159

[56] References Cited

U.S. PATENT DOCUMENTS

| | | | |
|---|---|---|---|
| 1,167,538 | 1/1916 | True | 72/159 |
| 2,357,006 | 8/1944 | Johnson | 72/158 X |
| 3,394,571 | 7/1968 | Rose | 72/159 |
| 4,479,373 | 10/1984 | Montorfano et al. | 72/158 |
| 4,567,745 | 2/1986 | Schwarze | 72/159 X |

FOREIGN PATENT DOCUMENTS

| | | | |
|---|---|---|---|
| 1112381 | 8/1961 | Fed. Rep. of Germany | 72/159 |

*Primary Examiner*—E. Michael Combs
*Attorney, Agent, or Firm*—Bacon & Thomas

[57] ABSTRACT

A bending die and a method of using the die to bend a pipe or the tube closely adjacent to an end of the tube having an end fitting is described. The bending die has a bending die member with a generally circumferentially extending groove around which the pipe or tube is bent. A clamping die member clamps an end portion of the tube against the bending die member. A clamping jaw member removably attached to the clamping jaw member, has a generally planar clamping face that contacts the end fitting on the pipe or tube. The bending die member defines a notch to accommodate a portion of the end fitting when the tube end is initially clamped to the bending die member. The method of bending the pipe or tube encompasses the steps of cutting the pipe to length, attaching the end fitting to the end of the pipe or tube (such as by welding), inspecting the end fitting-tube joint and subsequently bending the tube. In order to bend the tube, the end of the pipe or tube having the end fitting is placed into a portion of the groove on the bending die member such that the end fitting may be accommodated in the notch formed in the bending die member. The clamping die member than clamps this end of the tube against the bending die member such that a clamping jaw member removably attached to the clamping die member, has a generally planar clamping face that contacts the end fitting. The bending die member is then rotated relative to the pipe or tube to place initial bend in the tube.

9 Claims, 2 Drawing Sheets

METHOD AND APPARATUS FOR BENDING TUBES WITH END FITTINGS

BACKGROUND OF THE INVENTION

The present invention relates to apparatus for bending pipes or tubes having end fittings thereon and a method for using such apparatus.

Hydraulic and pneumatic systems aboard modern day aircraft are rather complex and require pipes or tubes to be formed with high geometric precision and quality. Typically the pipe or tube systems are fabricated from an initially straight pipe or tube by sequentially bending the tube, such bending being carried out in a variety of bending planes.

It is known to carry out such complex pipe or tube bending on an automated machine having numerically controlled and integrated operational parameters such that the machine automatically moves the pipe between consecutive bends, rotates the pipe to achieve bends in different planes and automatically controls the proper bending angle. European patent 0 168 331 describes a typical automated machine having a rotating shaping roller or die with a vertical rotation axis, that is provided with a circumferential semi-circular groove into which the pipe is placed. A second jaw clamps the pipe to the shaping or bending roller as they are rotated about the vertical axis to bend the pipe. The opposite end of the pipe is mounted in a chuck of the machine which may be traversed longitudinally to advance the tube, such that it may be bent in various locations, and which may be rotated to affect bending in various planes.

While the pipe and tube systems fabricated by the use of such machines have generally proven satisfactory, generally such machines are limited as to the bending of the pipe or tube close to its end, particularly where end fittings have been attached to the pipe or tube. In tubing having diameter between 6 and 25 millimeters, it has generally been proven infeasible to bend the pipe closer to the end than a distance generally equal to 2.5 times the diameter. In those instances where the geometrical requirements of the tubing is such that this limit cannot be met, it has been necessary to perfect the bend near the end of the pipe prior to cutting it to size and attaching the end fitting. This process is not only in and of itself time consuming, but also wastes pipe or tube material and renders the inspection of the weld attaching the end fitting more difficult.

Various attempts have been made to obviate this problem as exemplified by U.S. Pat. No. 4,481,803 to Dieser and French patent 2 388 612. In Dieser, an internal mandrel is utilized in conjunction with a bending die, a clamping die and a pressure die to bend the end of the tube. The French patent describes a tube manufacturing process that includes the shaping of end segments and provides for an increase in the tube diameter.

SUMMARY OF THE INVENTION

The present invention describes a bending die and a method of using the die to bend a pipe or tube closely adjacent to the end of the tube after the end fitting has been attached thereto. In tubing having a diameter D, the present invention enables the tube to be bent a distance L from the end fitting wherein L is approximately equal to D.

The bending die according to the invention has a bending die member with a generally circumferentially extending groove around which the pipe or tube is bent. A clamping die member clamps an end portion of the tube against the bending die member. A clamping jaw member removably attached to the clamping die member, has a generally planar clamping face that contacts the end fitting on the pipe or tube. The bending die member defines a notch to accommodate a portion of the end fitting when the tube end is initially clamped to the bending die member.

The method of bending the pipe or tube according to the invention utilizes the bending die noted above and encompasses the steps of cutting the pipe to length, attaching the end fitting to the end of the pipe or tube (such as by welding), inspecting the end fitting-tube joint and subsequently bending the tube.

In order to bend the tube, the end of the pipe or tube having the end fitting is placed into a portion of the groove on the bending die member such that the end fitting may be accommodated in the notch formed in the bending die member. The clamping die member then clamps this end of the tube against the bending die member such that a clamping jaw member removably attached to the clamping die member, has a generally planar clamping face that contacts the end fitting. The bending die member is then rotated relative to the pipe or tube to place an initial bend in the tube.

The clamping die member is then retracted from the bending die member and the pipe or tube is longitudinally advanced and/or rotated to locate the subsequent bend. At this point, the clamping jaw member having the planar clamping face is removed from the clamping die member and a second clamping jaw member, having a generally semi-cylindrical clamping surface is attached thereto. Once the clamping die member is advanced toward the bending die member such that the semi-cylindrical clamping surface engages the tube, rotation of the bending die member may then carry out further bending of the tube.

Following the initial bend of the pipe or tube, a supplemental bending die block may be attached to the bending die such that a semi-cylindrical groove formed on the supplemental bending die block is in alignment with the groove formed in the bending die member.

Utilizing the bending die according to this invention enables the pipe or tube to be cut to size, the end fitting attached thereto and the joint inspected prior to carrying out any bending operation. This minimizes the waste of pipe or tube material and enables these functions to be carried out in a more expeditious manner.

A BRIEF DESCRIPTION OF THE DRAWINGS

FIG. 1 is a perspective view of the bending die according to the invention with the planar face clamping jaw member in place.

FIG. 1*a* is a detailed, rear view of the tool shown in FIG. 1 illustrating the clamping die member and the clamping jaw member according to the invention.

DETAILED DESCRIPTION OF THE PREFERRED EMBODIMENT

Figure 1:
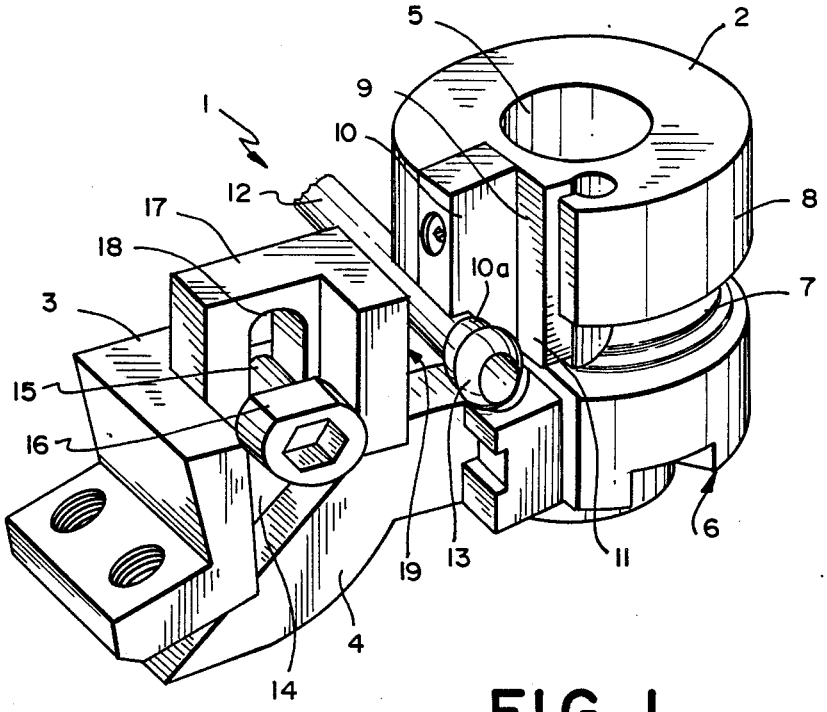

The bending tool according to the invention, as illustrated in FIG. 1, comprises a bending die member 2 and a clamping die member 3 fixedly joined to bending arm 4. The bending tool 1 is mounted on a known-type automatic bending machine, not shown. The bending die member 2 is mounted on a generally vertically extending, rotating shaft of the machine's bending head in known fashion, the shaft passing through central bore 5 while the base 6 of the bending die 2 rests on a plate of the bending head. Groove 7 has a generally semi-cylindrical cross-sectional shape and extends circumferentially around bending die member 2. The lower portion of bending die member 2 is rigidly attached to bending arm 4. The bending die member 2 defines a generally longitudinally extending clearance notch 9.

A bending die block 10 is rigidly attached to the bending die member 2 in the clearance notch 9. The width of the die block 10 is less than that of the clearance notch 9 so as to leave a clearance space 11 on the bending die member 2.

Figure 3:
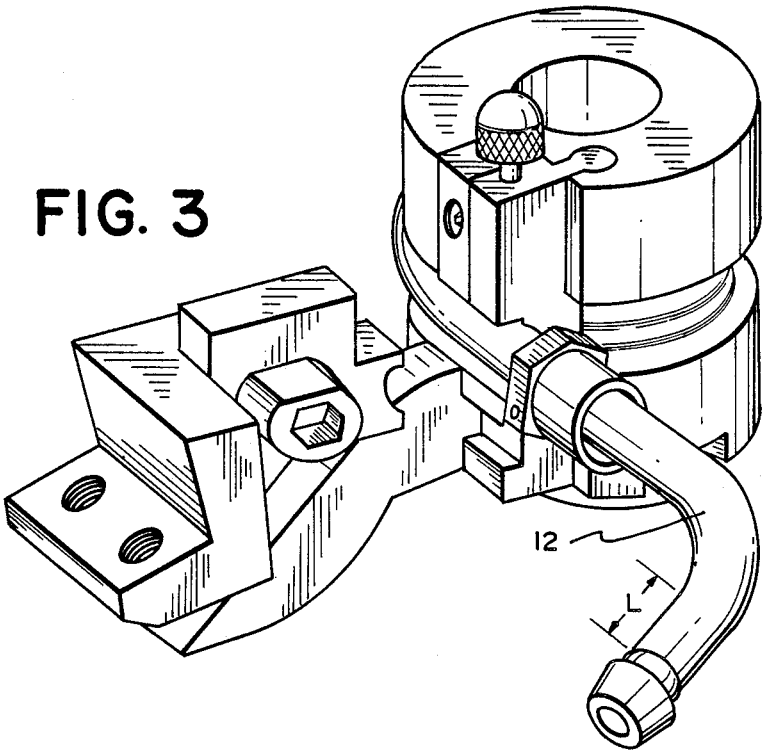
FIG. 3 is a perspective view similar to FIGS. 1 and 2 showing the completed installation of the second clamping jaw member and the supplemental bending die block.

In order to form an initial bend in the pipe or tube 12, a distance L from the end fitting 13 (see FIG. 3), the clearance 11 accommodates the end fitting 13 and prevents its contact with the bending die member 2. The pipe or tube 12 is placed against the bending die member 2 such that the end fitting 13 is closely adjacent to the die block 10.

Figure 1A:
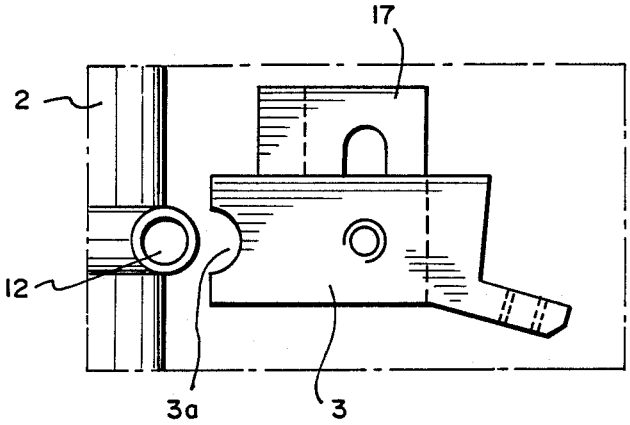

The clamping die member 3 also defines a seat portion 14 to which is attached shaft 15 having a head portion 16. The clamping jaw member 17 is removably attached to the clamping die member 3 by interengagement of the opening 18 with the shaft 15. Clamping jaw member 17 defines a substantially planar clamping face 19. As best seen in FIG. 1*a*, the clamping die member 3 defines a semi-circular clamping surface 3*a* to contact the pipe or tube 12.

In order to clamp the pipe or tube 12 against the bending die member 2, the clamping die member 3 is moved toward the die member 2 by a known actuating device on the bending machine until the clamping surface 3*a* engages the outer surface of the tube 12 and the planar clamping surface 19 contacts the end fitting 13. This contact serves to keep the extreme end portion of the pipe or tube 12 in contact with the bending die member 2, in particular, the groove 10*a* formed in the die block 10, during the bending operation. The planar surface 19 does not contact the pipe or tube 12, which is clamped by the surface 3*a* of the clamping die member 3.

The initial bending operation is carried out while the elements are in the position just described in reference to FIGS. 1 and 1*a* and the opposite end of the pipe or tube 12 (not shown) is held in a chuck of the automatic bending machine. The initial bend is automatically accomplished by the machine by rotating the bending arm 4 along with the bending die member 2 and the clamping die member 3 in known fashion.

Figure 2:
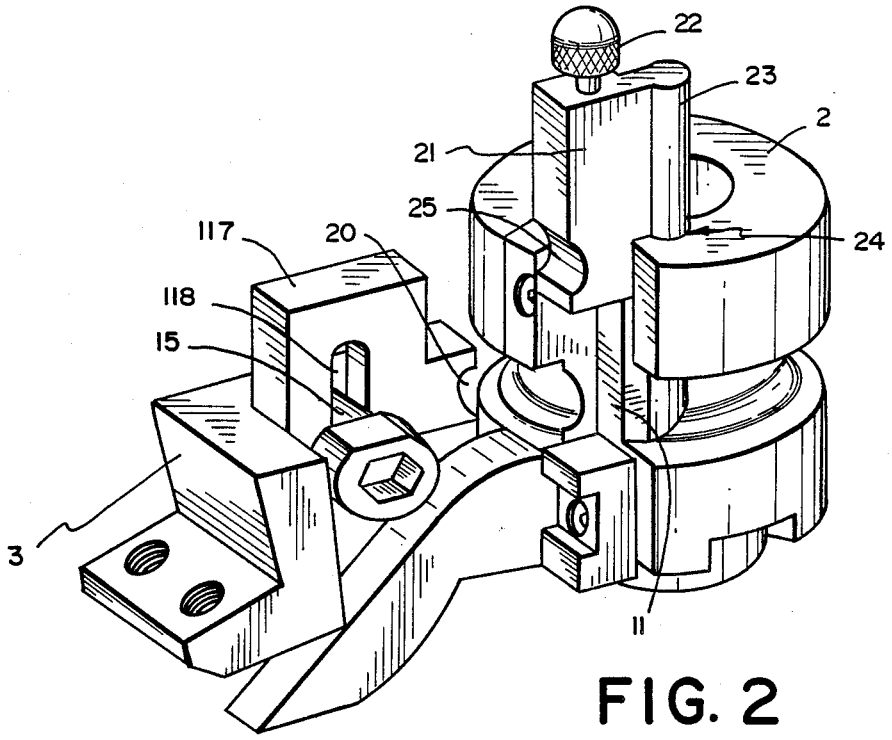
FIG. 2 is a perspective view similar to that shown in FIG. 1, illustrating the second clamping jaw member and the supplemental die block member.

Following the completion of the initial bend, the clamping die member 3 is retracted away from the bending die member 2 by the bending machine actuator (not shown) and the pipe or tube 12 may be longitudinally advanced by the machine to the next bending position. However, before the clamping die member 3 is returned to its clamping position, the clamping jaw member 17 is removed from the clamping die member 3 and a second clamping jaw 117 (see (FIG. 2) having an opening 118 is installed over the shaft 15 in similar fashion. The second clamping jaw member 117 defines a substantially semi-circular clamping surface 20 to clamp the pipe or tube 12 against the bending die 2.

Additionally, a supplemental bending die block 21 is attached to bending die block 2 by inserting enlarged guide portion 23 into a correspondingly shaped guide slot 24 extending generally longitudinally through the bending die 2. The supplemental bending die block 21 defines a semi-cylindrical die surface 25 which is longitudinally aligned with the groove 7.

With these removable elements in place, the clamping die member 3 is advanced toward the bending die member 2 so as to clamp the pipe or tube 12 therebetween. The machine then carries out the subsequent bending operation in the known fashion.

At the completion of the bending operations, the bending tool is returned to its initial configuration as shown in FIG. 1 in order to begin initial bending operations on a subsequent pipe or tube.

It is to be understood that the bending tool and method according to this invention may be utilized with bending a pipe or tube having an inner mandrel present during the bending operation.

The foregoing description is provided for illustrative purposes only and should not be construed as in any way limiting this invention, the scope of which is defined solely by the appended claims.

What is claimed is:

1. A bending die for bending a pipe or tube having an end fitting on an end thereof comprising:
   (a) a bending die member having a generally cylindrical configuration defining a generally circumferentially extending die groove having a substantially semi-circular cross-sectional configuration to accommodate the pipe or tube therein and further defining a generally longitudinally extending clearance notch extending across the die groove to provide a clearance for a portion of the end fitting therein;
   (b) a clamping die member having a generally semi-circular clamping surface positioned to contact the pipe or tube and clamp it into at least a portion of the die groove; and,
   (c) a clamping jaw member on the clamping die member, the clamping jaw member having a substantially planar clamping face positioned to contact only the end fitting during the bending operation so as to enable the pipe or tube to be bent a distance L from its end.

2. The bending die according to claim 1 wherein the pipe or tube has a diameter D and wherein the distance L is approximately equal to D.

3. The bending die according to claim 1 further comprising attaching means to removably attach the clamping jaw member to the clamping die member.

4. A method of bending a tube or pipe having an end fitting on an end thereof comprising the steps of:
   (a) placing the end of the pipe or tube against a die groove of a bending die member such that at least a portion of the end fitting extends into a notch formed in the bending die member to provide a clearance between the die member and the fitting;
   (b) moving a clamping die member defining a generally semi-circular clamping surface and having a clamping jaw member with a substantially planar clamping face toward the bending die member such that the planar clamping face contacts only the end fitting and the pipe or tube is clamped between the bending die member and the clamping die member; and, (c) bending the pipe or tube around at least a portion of the bending die so as to bend the pipe or tube a distance L from its end.

5. The method according to claim 4 wherein the pipe or tube has a diameter D wherein the step of bending the pipe or tube is such that L is approximately equal to D.

6. The method according to claim 4 comprising the additional steps of:

(a) moving the clamping die member away from the bending die after bending the pipe or tube;

(b) repositioning the pipe or tube with respect to the bending die member;

(c) removing the clamping jaw member having the substantially planar clamping face from the clamping die member;

(d) attaching a second clamping jaw member having a substantially semi-circular clamping face to the clamping die member;

(e) moving the clamping die member toward the bending die member such that the pipe or tube is clamped therebetween; and, (f) further bending the pipe or tube around at least a portion of bending die member.

7. The method according to claim 6 comprising the additional step of attaching a supplemental bending die block to the bending die member after the clamping die member has been moved away from the bending die member.

8. The method according to claim 7 comprising, before placing the end of the pipe or tube against the bending die member, carrying out the additional steps of:

(a) cutting the pipe or tube to a predetermined length; and, (b) attaching an end fitting to at least one end of the pipe or tube.

9. The method according to claim 8 wherein the end fitting is attached to the pipe or tube by welding and comprising the additional step of inspecting the weld by an x-ray process after attaching the end fitting.

* * * * *